US006089558A

United States Patent [19]

Okumura

[11] Patent Number: 6,089,558

[45] Date of Patent: Jul. 18, 2000

[54] SHEET HANDLING UNIT AFTER IMAGE FORMATION

[75] Inventor: Keiji Okumura, Osaka, Japan

[73] Assignee: Kyocera Mita Corporation, Osaka, Japan

[21] Appl. No.: 08/998,899

[22] Filed: Dec. 29, 1997

[30] Foreign Application Priority Data

Jan. 17, 1997 [JP] Japan ..... 9-006797

[51] Int. Cl.[7] ..... B65H 39/07

[52] U.S. Cl. ..... 270/58.11; 270/58.12; 414/690.2; 414/788.2; 414/791.2; 414/791.5

[58] Field of Search ..... 270/58.11, 58.13, 270/58.12, 58.08; 271/213, 214, 218, 207; 414/690.2, 788.2, 788.3, 791.2, 791.5, 790.3

[56] References Cited

U.S. PATENT DOCUMENTS

| | | | |
|---|---|---|---|
| 4,134,672 | 1/1979 | Burlew et al. | 270/58 |
| 4,469,321 | 9/1984 | Geshwindmer | 271/218 |
| 4,497,478 | 2/1985 | Reschenhofer | 270/58.11 |
| 4,605,211 | 8/1986 | Sonobe | 270/53 |
| 4,623,291 | 11/1986 | Buck | 414/788.3 |
| 4,905,979 | 3/1990 | Limbach et al. | 414/791.2 |
| 5,018,717 | 5/1991 | Sadwick et al. | 271/213 |
| 5,020,784 | 6/1991 | Asami et al. | 270/58.11 |
| 5,074,743 | 12/1991 | Schaffner et al. | 271/218 |
| 5,114,130 | 5/1992 | Hamanaka et al. | 270/58.11 |
| 5,447,298 | 9/1995 | Watanabe | 270/58.11 |
| 5,609,333 | 3/1997 | Mandel et al. | 270/58.11 |
| 5,782,466 | 7/1998 | Regimbal et al. | 270/58.08 |
| 5,909,871 | 6/1999 | Takehara | 270/58.11 |
| 5,975,522 | 11/1999 | Fujimaki | 271/213 |

*Primary Examiner*—Christopher P. Ellis
*Assistant Examiner*—Khoi H. Tran
*Attorney, Agent, or Firm*—Jordan and Hamburg LLP

[57] ABSTRACT

This invention relates to a sheet handling unit. The sheet handing device has an intermediate tray which receives a copy sheet discharged through an outlet port of a transport guide member at a predetermined receiving position, and a hand unit which holds a portion of the sheet set on the intermediate tray to transfer the sheet set from the intermediate tray onto a sheet stacker. The intermediate tray carrying the sheet set thereon and the hand unit move toward a sheet releasing position in a state that the hand unit holds the portion of the sheet set to transfer the sheet set to the sheet releasing position. The hand unit pauses at the sheet releasing position while holding the portion of the sheet set. Meanwhile, the intermediate tray moves to a retract position away from the sheet stacker, and the hand unit releases the holding of the sheet set at the sheet releasing position. Thereby, the sheet set is transferred onto the sheet stacker from the intermediate tray.

19 Claims, 11 Drawing Sheets

SHEET HANDLING UNIT AFTER IMAGE FORMATION

BACKGROUND OF THE INVENTION

1. Field of the Invention

This invention relates to a sheet handling unit used in sorting out copy sheets discharged out of a main body of an image forming apparatus such as a copying machine and a printer.

2. Description of the Background Art

Conventionally, there have been known various types of sheet handling units (or post processing units) used with an image forming apparatus such as a copying machine and a printer in which a sorting process, a mechanical sheet process such as stapling and punching, and a stacking process are applied in a series to copy sheets after an image formation by the image forming apparatus.

More specifically, such sheet handling unit is operated such that:

1) in a sorting process, copy sheets discharged out of a main body of an image forming apparatus are sorted out on bin trays that are movable up and down in synchronism with a sheet discharge operation to obtain sheet sets respectively placed on the bin trays;
2) in a mechanical sheet process, a stapling or a punching operation is applied to each of the sheet sets on the bin trays; and
3) in a stacking process, the sheet sets having been applied with the mechanical sheet process thereto are discharged onto a common sheet stacker via a specified transport route in a state that the sheet sets are stacked one over another.

The sheet handling unit having the above arrangement has suffered from various drawbacks. One of the drawbacks is non-aligned stacked state of sheet sets on the sheet stacker due to the following two main reasons.

One reason is that a next sheet set S2 coming onto the sheet stacker displaces the previously stacked sheet set S1 forward due to a frictional force generated between these sheet sets when the next sheet set S2 is sliding over the previous sheet set S1. The result is a non-aligned stacked state of sheet sets on the sheet stacker.

Another reason is that in the case where a stapling is applied to the lead end of the sheet set with respect to the sheet set discharge direction, the lead end of the next sheet set S2 is tripped over the staple(s) applied to the previous sheet set S1, resulting in displacing (pushing) forward the previous sheet set S1. The result is also a non-aligned stacked state of sheet sets on the sheet stacker.

Further, the above sheet handling unit has confronted another problem, damage of the sheet surface of sheet sets in contact with each other due to a staple applied to the sheet set S2 or to the sheet set S1.

SUMMARY OF THE INVENTION

In view of the above drawbacks, it is an object of this invention to provide a sheet handling unit that realizes aligned stacked state of sheet sets on a sheet stacker.

It is another object of this invention to provide a sheet handling unit that enables stacking of copy sheets sets on a sheet stacker without a possibility of damaging a sheet surface of these sheet sets when a stapling has been applied to the sheet sets.

To accomplish the above objects, the present invention is directed to a sheet handling unit after an image formation comprising: a sheet stacker on which sheet sets are stacked one over another; a transport guide member including an inlet port and an outlet port for receiving the sheet sets through the inlet port and discharging the sheet sets through the outlet port successively; and an intermediate tray disposed at a position higher than the sheet stacker for receiving the sheet set discharged through the outlet port at a predetermined receiving position to transfer the sheet set onto the sheet stacker.

With this a arrangement, the sheet sets are temporarily received on the intermediate tray one after another through the outlet port of the transport guide member, and transferred onto the sheet stacker one after another. As the receiving and transferring operation is conducted successively, the sheet sets are stacked one over another on the sheet stacker.

The above and other objects, features and advantages of the present invention will become more apparent upon a reading of the following detailed description and drawings.

DETAILED DESCRIPTION OF THE PREFERRED EMBODIMENTS OF THE INVENTION

Figure 1:
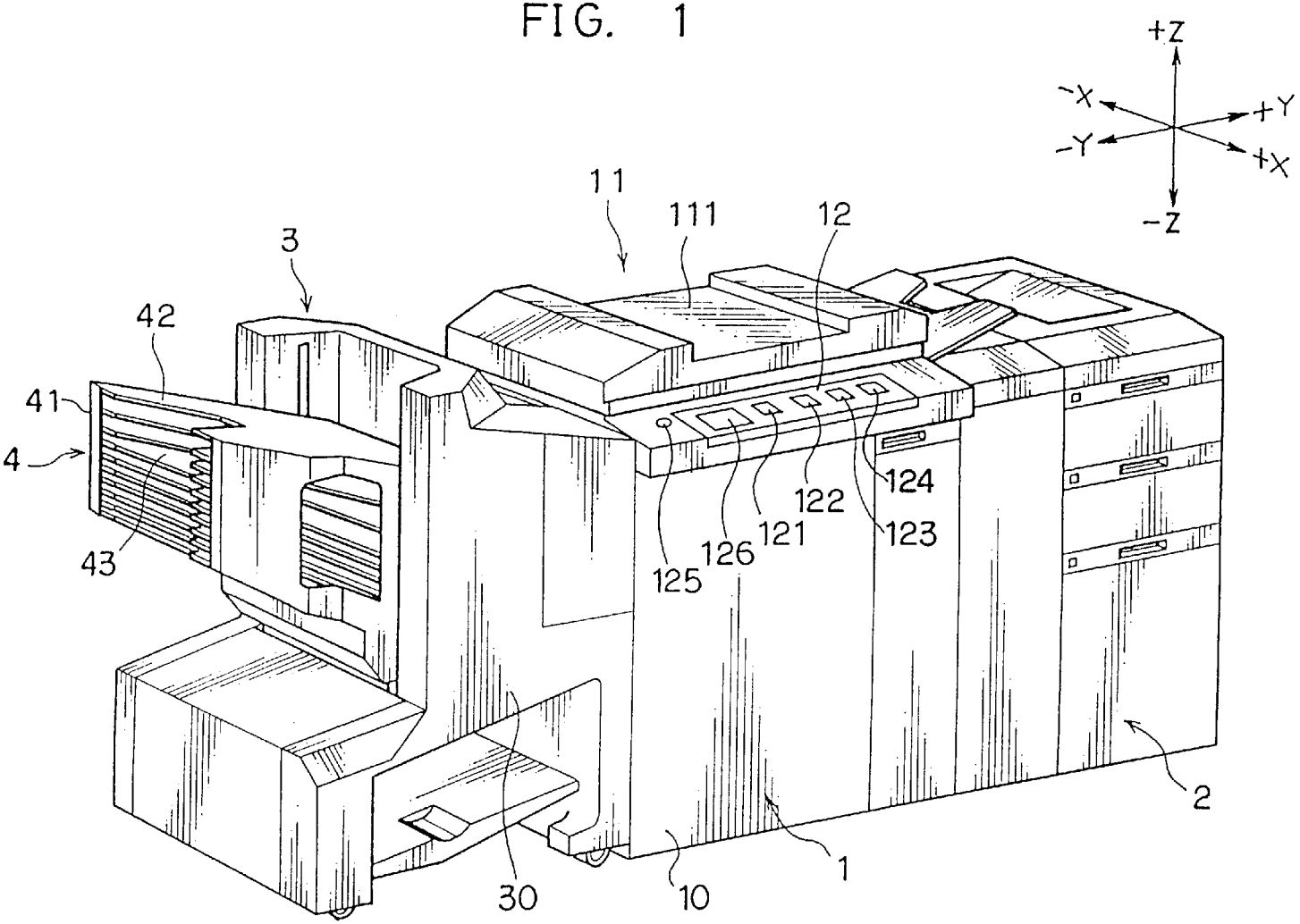
FIG. 1 is a perspective view of an external appearance of a copying machine incorporating a sheet handling unit as an embodiment according to this invention.

FIG. 1 is a perspective view showing an external appearance of an image forming apparatus (in this embodiment, copying machine) incorporating a sheet handling unit (or post processing unit) embodying this invention. To clarify the directional relationship of various parts to be described later with reference to the drawings, X-, Y-, and Z-coordinates are shown in the drawings when needed. The arrow of +X direction represents frontal direction: −X direction represents rearward direction; +Y direction represents rightward direction; −Y direction represents leftward direction; +Z direction represents upward direction; and −Z direction represents downward direction of the copying machine.

[Schematic arrangement of copying machine]

As shown in FIG. 1, the copying machine comprises a main body 1, a paper storage unit 2 arranged on the right side of the main body 1 (i.e., on the +Y side), and a sheet handling unit 3, which includes a sorter, arranged on the left side of the main body 1 (ie., on the −Y side).

The machine main body 1 has a housing unit 10. In the middle of the top portion of the housing unit 10, there is provided a contact glass (not shown). An automatic document feeder 11 is arranged on the contact glass. The automatic document feeder 11 has a document setting portion (or document discharge portion) 111. The automatic document feeder 11 is operated such that original documents set on the document setting portion 111 are automatically fed on a specified position of the contact glass one by one and returned to the document discharge portion 111 after image reading.

The housing unit 10 is internally provided with various constituent elements (all of which are not illustrated in the drawings) such as an optic system for optically scanning an image of an original document set on the contact glass, an imaging unit including various parts such as a photosensitive drum and a developing unit, a fixing unit for effecting an image fixation, and a sheet transport unit for transporting a copy sheet along a certain sheet transport path.

An operation panel 12 is provided on the upper portion of the housing unit 10. The operation panel 12 is arranged with various setting keys such as a start switch 121, a copy sheet (set) number setting key 122, a mode selecting key 123 for selectively designating sorter mode to effect a specified operation by the sheet handling unit 3 or non-sorter mode, copy sheet size designating key 124, and a punching mode setting key 125, and is further provided with a display device 126 for displaying contents designated by the various setting keys.

The paper storage unit 2 is adapted for feeding a copy sheet to the imaging unit of the main body 1 via the sheet transport unit, and accommodates various sizes of copy sheets therein.

With this arrangement, i.e., with the combination of the main body 1 and the paper storage unit 2, a copying operation of an original document image on a sheet of paper is performed in the following manner. Specifically, when an original document is fed to the specified position on the contact glass by the automatic document feeder 11, the image of the original document is read by the optic system, and an electrostatic latent image is formed on the surface of the photosensitive drum of the imaging unit to develop the latent image into a toner image. The toner image is transferred onto a copy sheet fed from the paper storage unit 2 via the sheet transport unit, and fixed thereon by the fixing unit. The copy sheet carrying the fixed toner image is discharged toward the sheet handling unit 3 disposed adjacent to a sheet outlet port of the housing unit 10.

In this way, the copy sheets after the copying operation are successively discharged toward the sheet handling unit 3 and applied with a certain process by the sheet handling unit 3 according to needs.

[Arrangement of sheet handling unit]

First, the arrangement of the sheet handling unit 3 is described mainly focusing on a function as a sorter.

Figure 2:
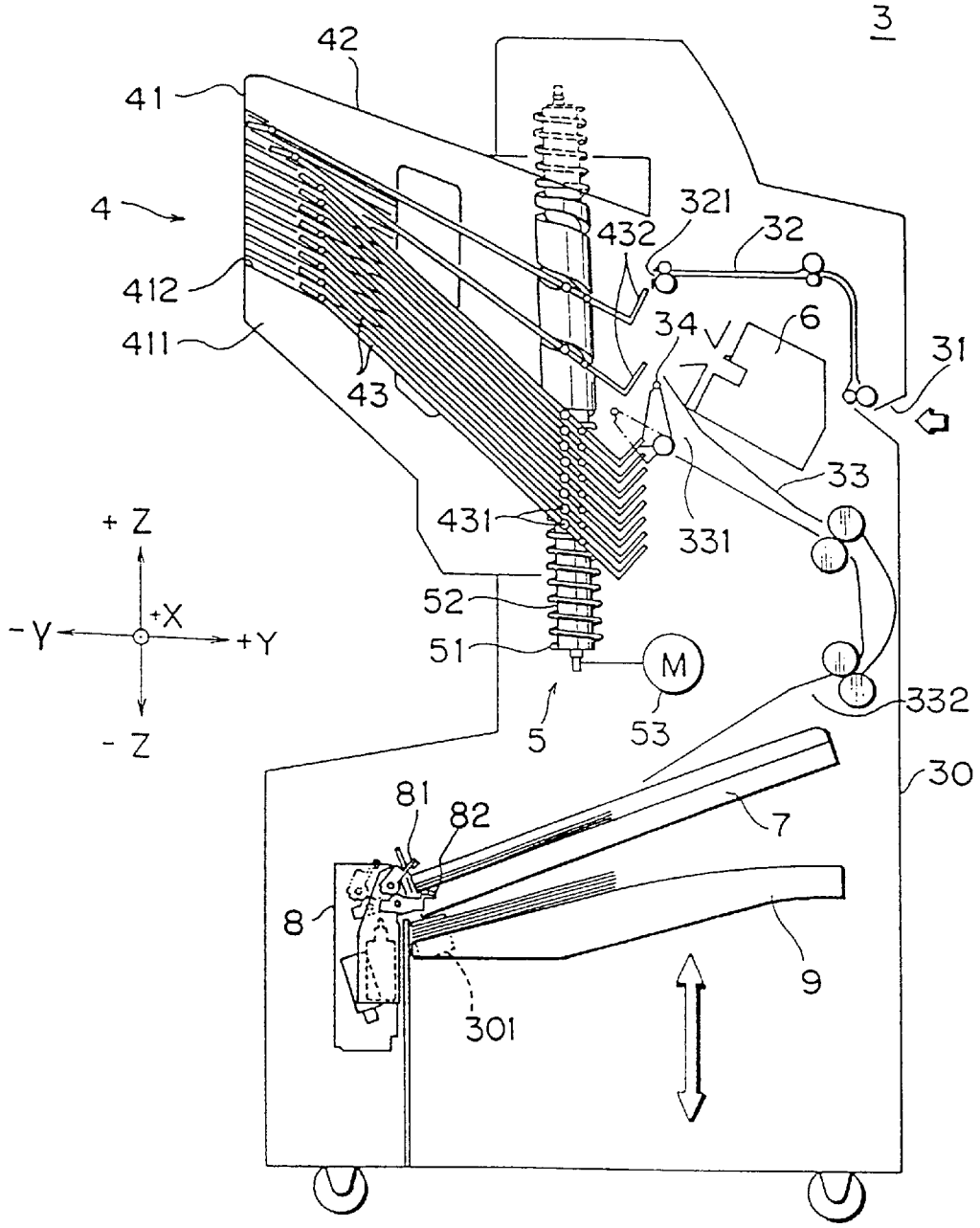
FIG. 2 is an elevating view showing an interior arrangement of the sheet handling unit.

FIG. 2 is a diagram showing an internal arrangement of the sheet handling unit 3. The sheet handling unit 3 is constructed such that a copy sheet fed out from the main body 1 is received inside a sorter housing unit 30 through a sheet inlet port 31 formed on the upper right side thereof and is further transported to a bin unit 4 arranged on the upper left side of the sorter housing unit 30 via a first sheet transport path 32.

The upper portion of a bin unit frame member 41 of the bin unit 4 constitutes a non-sort tray 42 for stacking copy sheets thereon when the sorter mode is not designated.

Plural bin trays 43 are vertically arranged spaced apart by a certain height in the Z direction inside the bin unit frame member 41 to be slidable independently of one another along a guide groove 412 formed in an inner side wall 411 of the bin unit frame member 41.

The bin unit frame member 41 and the bin trays 43 are integrally vertically movable by an elevating mechanism 5 which is described later. With this arrangement, either one of the non-sort tray 42 and bin tray 43 is moved to a position opposing to a sheet outlet port 321 of the first sheet transport path 32 to receive a copy sheet fed out from the main body 1.

The elevating mechanism 5, as shown in FIG. 2, comprises a pair of rotational shafts 51 set in an upright posture on the right side (+Y side) of the bin tray 43 spaced apart from each other such that the shafts 51 interpose the bin trays 43 therebetween in the X direction. Hereinafter, the rotational shaft 51 is referred to as a "spiral camshaft", and only the spiral camshaft in the −X direction is shown in FIG. 2.

The spiral camshaft 51 is formed with a spiral groove 52 around a circumference thereof spaced apart with a certain pitch in the axial direction. A pin 431 projecting outward of the bin tray 43 in the X direction engages in the spiral groove 52.

A pulse motor 53 is connected to the spiral camshaft 51 at the lower end thereof via a transmission mechanism (not shown). A rotational amount of the pulse motor 53 is controlled in accordance with a signal outputted by a controller 130 to be described later.

With this arrangement, by rotating the spiral camshaft 51 in the forward or reverse direction by 360°, the bin tray 43 is vertically shifted (in the Z direction) stage by stage together with the bin unit frame member 41.

The shifting operation of the bin trays 43 synchronizes with a discharging operation of copy sheet from the main body 1, thereby sorting out the copy sheets on the bin trays 43. When the copying machine is set at the non-sorter mode, the non-sort tray 42 has its height maintained at the same level as the sheet outlet port 321.

[Arrangement of sheet processing unit]

Next, the arrangement of a sheet processing unit of the sheet handling unit 3 is described. The sheet handling unit 3 is provided with a sheet processing unit 6 for effecting various mechanical sheet processing (hereinafter also referred to as "sheet processing") such as stapling in which a set of copy sheets is bound together by a stapler, or punching in which a ring binder hole or binder hole is formed in a copy sheet or in a set of copy sheets.

More specifically, after the sorting is completed, in the case where a stapling or punching operation is applied to each of the sheet sets placed on the bin trays 43, the spiral camshaft 51 is rotated to temporarily vertically shift all the bin trays 43 in the +Z direction. Then, the bin tray 43 carrying the sheet set for which a sheet processing is to be effected is lowered stage by stage to the position opposing to the sheet processing unit 6.

In this state, the bin tray 43 shifted to the specified position is moved toward the sheet processing unit 6 to move the set of copy sheets placed on the bin tray 43 to a certain position for enabling sheet processing by the sheet processing unit 6. Thereupon, the sheet processing unit 6 is activated to effect a sheet processing to the set of copy sheets.

A sheet inlet port (or inlet port) 331 of a second sheet transport path (or transport guide member) 33 is located below the sheet processing unit 6 to guide the sheet set after the sheet processing into the second sheet transport path 33 from the bin tray 43 by tilting the bin tray 43 downward in the +Y direction. Specifically, the sheet set on the bin tray 43 slides down from the bin tray 43 into the second sheet transport path 33 through the sheet inlet port 331 over the downward slope formed by angular inclination of the bin tray 43.

In order to reliably enable sliding of the sheet set into the second sheet transport path 33, the inclination angle of the bin tray 43 needs to be great enough. Accordingly, the pitch of the spiral groove 52 in the spiral camshaft 51 at the position opposing to the sheet inlet port 331 is wider than the other portion.

With this arrangement, when the spiral camshaft 51 rotates by 360° at the sheet inlet port 331, the downward moving distance of the bin tray 43 at the right end in the +Y direction becomes larger.

More specifically, despite the fact that the downward moving distance of the bin tray 43 at the right end increases at the sheet inlet port 331, the opposite end (left end) portion in the −Y direction of the bin tray 43 moves downward by the predetermined small pitch because of engagement with the guide groove 412 formed in the inner side wall 411 of the bin unit frame member 41. Thereby, when the right end of the bin tray 43 reaches the position opposing to the sheet inlet port 331 of the second sheet transport path 33, the bin tray 43 is inclined greatly downward rightward in FIG. 2.

There is provided a pivotable lever 34 at the sheet inlet port 331. Accompanied by a pivotal movement of the lever 34 and shifting operation of the bin tray 43 in the −Z direction, the lead end of the lever 34 proceeds into the right end of the bin tray 43 through a cutaway (not shown) formed in the bin tray 43 to lift up the sheet set on the bin tray 43. When the bin tray 43 is further lowered, the sheet set in an inclined state on the bin tray 43 climbs over the upper edge of a stopper 432 of the bin tray 43 by the weight thereof, thereby slipping into the sheet inlet port 331 of the second sheet transport path 33. Thus, the sheet set is guided to an intermediate tray 7 along the second sheet transport path 33 through a sheet outlet port 332.

[Arrangement of sheet stacking/alignment system]

Next, briefly described is the arrangement of a sheet stacking/alignment system to enable stacking of sheet sets in an aligned state, which is the gist of this invention. The sheet stacking/alignment system comprises the intermediate tray 7, a hand unit 8, and a sheet stacker 9 of the sheet handling unit 3. The detailed arrangement of these constituent elements will be described later.

The intermediate tray 7, as shown in FIG. 2, reciprocates in the X direction at the lower inside of the sheet handling unit 3. After having temporarily received the sheet set thereon, the intermediate tray 7 is operated to transfer the sheet set to the sheet stacker (or stack tray) 9 in association with the hand unit 8 arranged on the left end (−Y direction) of the intermediate tray 7.

Specifically, the sheet stacker 9 is disposed below the intermediate tray 7 and on the front side (+X direction) of the s sheet handling unit 3. The sheet handling unit 3 is operated in the following manner to transfer a sheet set from the intermediate tray 7 to the sheet stacker 9.

First, the intermediate tray 7 receives a sheet set after a sheet processing (in this embodiment, stapling) at the rear side (−X side) relative to the sheet stacker 9, and a pair of hands 81 and 82 of the hand unit 8 hold the sheet set at the left front end of the copying machine in FIG. 2 (the −Y and +X side). Thereafter, the intermediate tray 7 and the hand unit 8 integrally move forward in the +X direction to transfer the sheet set toward the stack tray 9 located on the +X side.

Subsequently, when the intermediate tray 7 retracts rearward in the −X direction in a state that the hand unit 8 maintains the position above the sheet stacker 9 on the +X side, the sheet set is halfway transferred from the intermediate tray 7 to the stack tray 9 in a state that the hands 81 and 82 of the hand unit 8 still hold the portion of the sheet set. Then, when the hand unit 8 releases the sheet set, transfer of the sheet set from the intermediate tray 7 to the sheet stacker 9 is finalized.

Thus, upon completion of the transfer of sheet set to the sheet stacker 9, the hand unit 8 retracts rearward in the −X direction, and sets in a stand-by state to wait for a next sheet set coming onto the intermediate tray 7.

As shown in FIG. 2, the sheet stacker 9 is movable up and down, and each time a set of copy sheets is or a certain number of sheet sets are stacked thereon, the stack tray 9 lowers stage by stage from the initial uppermost position while being guided along guide rails (not shown) provided in an upright posture on the rear side (−X direction) of the sorter housing unit 30.

The reference numeral 301 in FIG. 2 is a sheet detecting unit for detecting presence of sheet sets stacked on the stack tray 9. The vertical movement of the stack tray 9 in the Z direction is controlled based on a detection signal outputted by the sheet detecting unit 301.

[Arrangement of intermediate tray]

Figure 3:
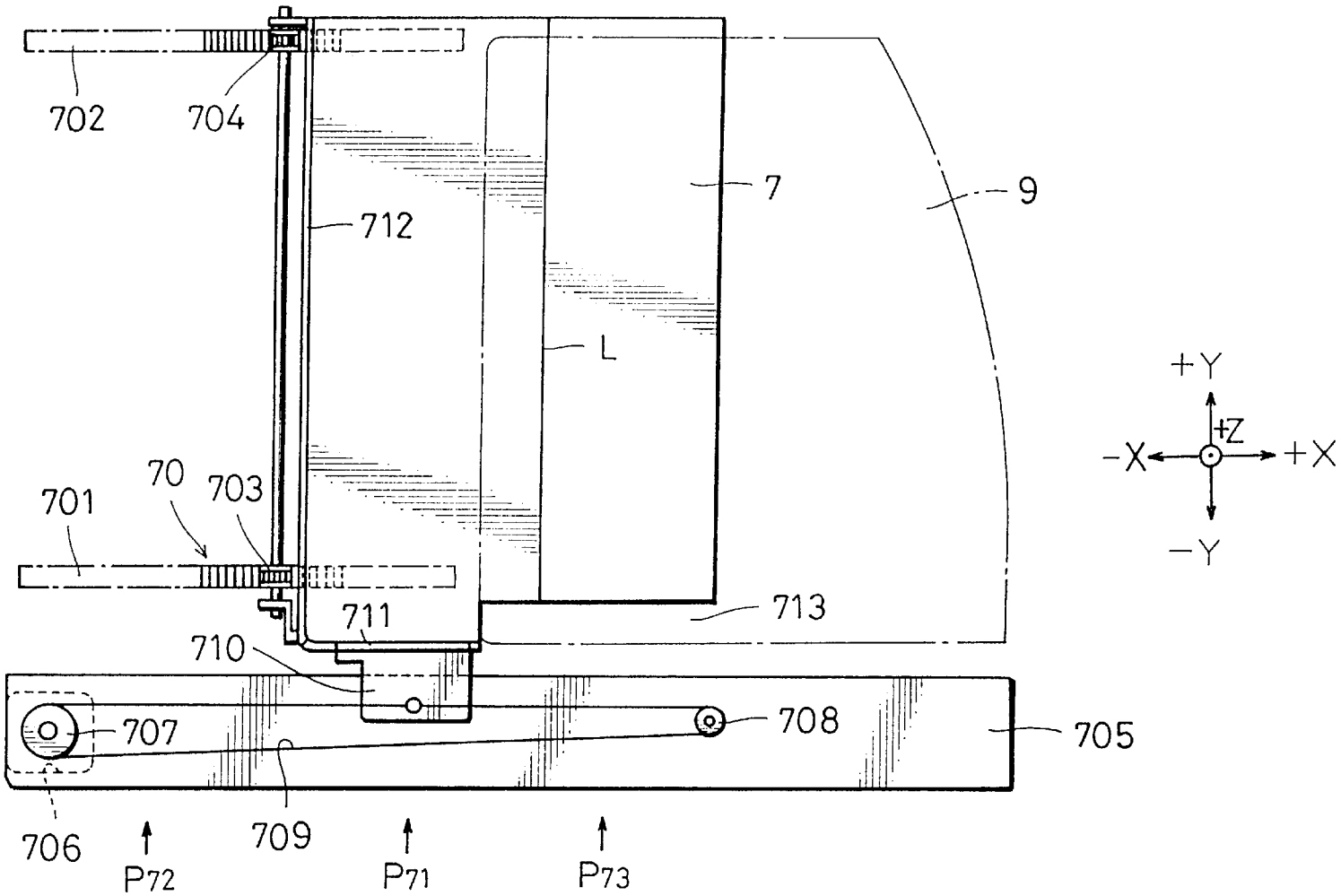
FIG. 3 is a plan view of an arrangement of an intermediate tray of the sheet handling unit.
Figure 4:
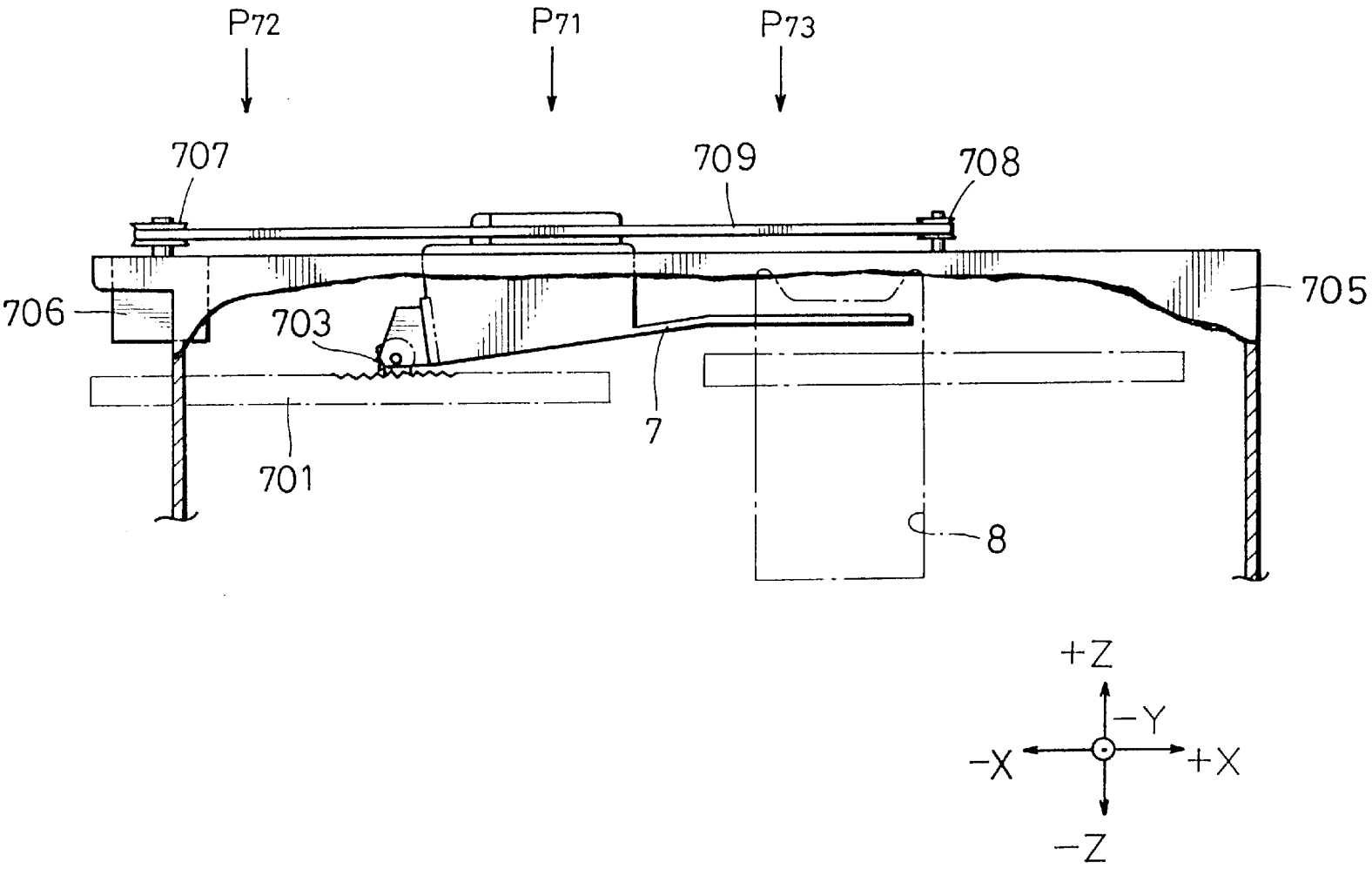
FIG. 4 is a side view of the arrangement of the intermediate tray.

Next, the detailed arrangement of the intermediate tray 7 is described with reference to FIGS. 3 and 4. FIGS. 3 and 4 are respectively a plan view and a side view of the intermediate tray 7.

As shown in FIGS. 3 and 4, the intermediate tray 7 is movable in the X direction back and forth at a position higher than the sheet stacker 9 in the Z direction. More specifically, an intermediate tray drive mechanism 70 moves the intermediate tray 7 to the positions shown by the arrows P71, P72 and P73 in FIG. 3 where the positions P71, P72, and P73 are such that:

- P71: receiving position (RCV pos) at which a sheet set discharged through the outlet port 332 of the sheet transport path (transport guide member) 33 is to be received on the intermediate tray 7;
- P72: retract position (RTR pos) away from the sheet stacker 9 in the −X direction; and
- P73: forward position (FWD pos) away from the receiving position P71 in the +X direction, the position right above the sheet stacker 9 to enable transfer of the sheet set from the intermediate tray 7 onto the sheet stacker 9.

It should be noted that the receiving position P71 is variably settable according to the size of sheet set relative to the X direction. In the case where a sheet set of a large size in the X direction is to be discharged, the receiving position is set rearward in the −X direction from the position P71 shown in FIG. 3, while being set forward in the +X direction from the receiving position P71 when a sheet set of a small size is to be discharged.

The intermediate tray drive mechanism 70 comprises a pair of racks 701, 702 disposed opposing to each other in the Y direction on the −X side of the receiving position P71, a pair of pinions 703, 704 respectively movable along the extending direction (X direction) of the racks 701, 702, a drive motor 706 that is arranged on the −Y and −X side of the intermediate tray 7 and is mounted on a support frame 705, a first pulley 707 mounted on a rotary shaft of the drive motor 706, a second pulley 708 mounted on a specified position on the +X side of the support frame 705, a timing belt 709 wound around the first and second pulleys 707 and 708, and an engaging member 710 protruding outward in the −Y direction from the intermediate tray 7 to be movable in association with driving of the timing belt 709.

The intermediate tray 7 is formed with a first stopper wall 711 in an upright posture on the −Y end (and extending in the X direction) thereof, and with a second stopper wall 712 in the −X end thereof also in an upright posture.

As shown in FIG. 2, the intermediate tray 7 has a downward slope in the −Y direction and a downward slope in the −X direction gradually tilted from the ridge shown by the symbol L (see FIG. 3). The intermediate tray 7 is further formed with a cutaway (or hollow space) 713 on the −Y side and in the +X direction thereof. Since the intermediate tray 7 has the downward slope in the −Y direction, the rack 702 on the +Y side has the height higher than the rack 701 on the −Y side.

With this arrangement in which the intermediate tray 7 has the downward slopes respectively oriented in the −X direction and in the −Y direction, a sheet set discharged through the outlet port 332 of the transport guide member 33 slides down over the −Y oriented slope and stops at the first stopper wall 711, while sliding down over the −X oriented slope and stops at the second stopper wall 712. Accordingly, the sheet set securely lands at a predetermined position on the intermediate tray 7 with the ends in the −Y direction and in the −X direction aligned along the first stopper wall 711 and the second stopper wall 712 respectively.

[Arrangement of hand unit]

Figure 5:
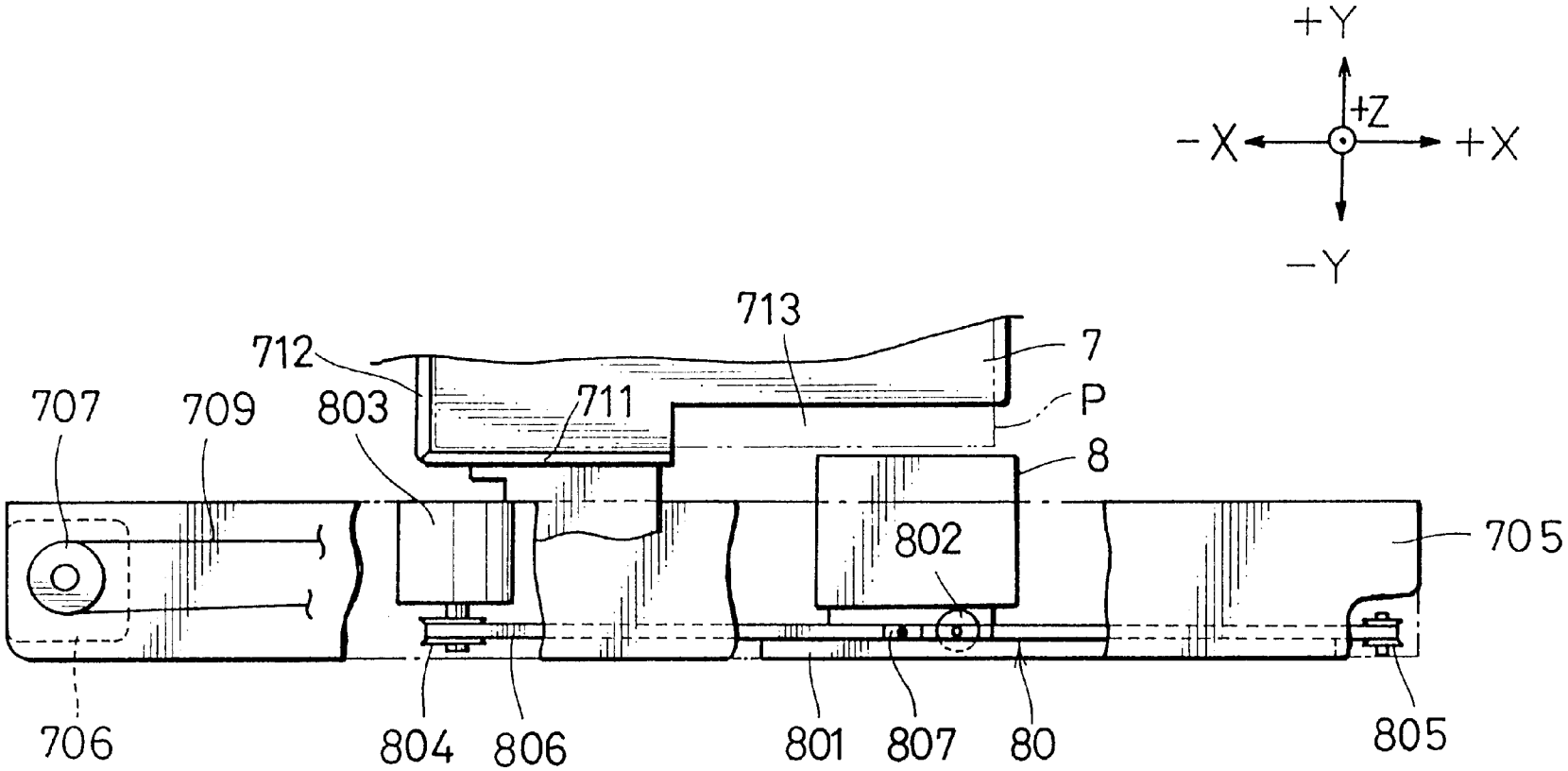
FIG. 5 is a plan view of an arrangement of a hand unit of the sheet handling unit.
Figure 6:
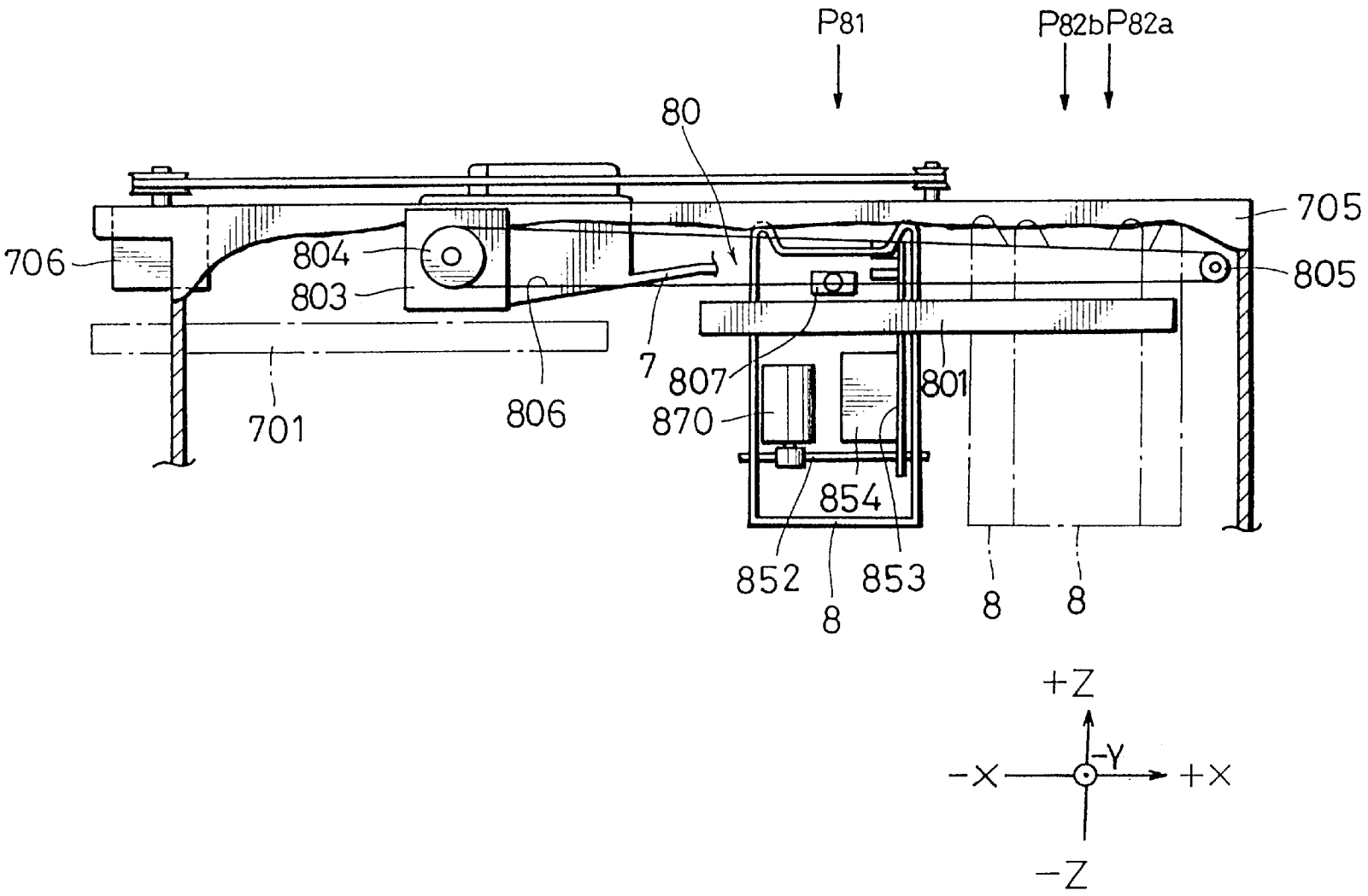
FIG. 6 is a side view of the arrangement of the hand unit of the sheet handling unit.

Next, the arrangement of the hand unit 8 is described in detail with reference to FIGS. 5 and 6. FIG. 5 is a plan view and FIG. 6 is a side view of the hand unit 8. As shown in these drawings, the hand unit 8 is disposed adjacent to the intermediate tray 7 in the −Y direction. A hand unit drive mechanism 80 moves the hand unit 8 to the positions shown by the arrows P81, P82*a*, and P82*b* in FIG. 6 where the positions P81, P82*a*, and P82*b* are such that:

P81: home position at which the hand unit 8 opposes to the space 713 when the intermediate tray 7 is set at the RCV pos, position where the hand unit 8 initiates holding of the sheet set landed on the intermediate tray 7; and P82*a*, P82*b*: sheet releasing positions (S/R positions) away from the home position P81 in the +X direction, shown by the phantom lines in FIG. 6 where the sheet set from the intermediate tray 7 held by the hand unit 8 is transferred onto the sheet stacker 9. The position P82*a* is further away from the home position P81 than the position P82*b*.

It should be noted that the home position P81 is variably settable in correspondence to the receiving position P71 of the intermediate tray 7. Further, there are provided two sheet releasing positions P82*a* (+X side) and P82*b* (−X side) with respect to the sheet stacker 9 to stack the sheet sets one over another on the sheet stacker 9 alternately on the −X side and on the +X side.

The two sheet releasing positions P82*a* and P82*b* may be set variable in accordance with the size of sheet set relative to the X direction or may be fixedly set at a predetermined position irrespective of the sheet set size.

The hand unit drive mechanism 80 comprises a guide rail 801 disposed on the −Y side of the support frame 705, a slidable member 802 such as a roller which slides along the guide rail 801, a drive motor 803 mounted on the support frame 705, a first pulley 804 mounted on a rotary shaft of the drive motor 803, a second pulley 805 mounted on the +X end of the support frame 705, a timing belt 806 wound around the first and second pulleys 804 and 805, and an engaging member 807 protruding outward in the −Y direction from the hand unit 8 to be movable in association with driving of the timing belt 806. The guide rail 801 extends in the X direction along the support frame 705.

Next, the operation as to how the hands 81 and 82 of the hand unit 8 hold a sheet set on the intermediate tray 7 is described with reference to FIGS. 7 and 8.

Figure 7:
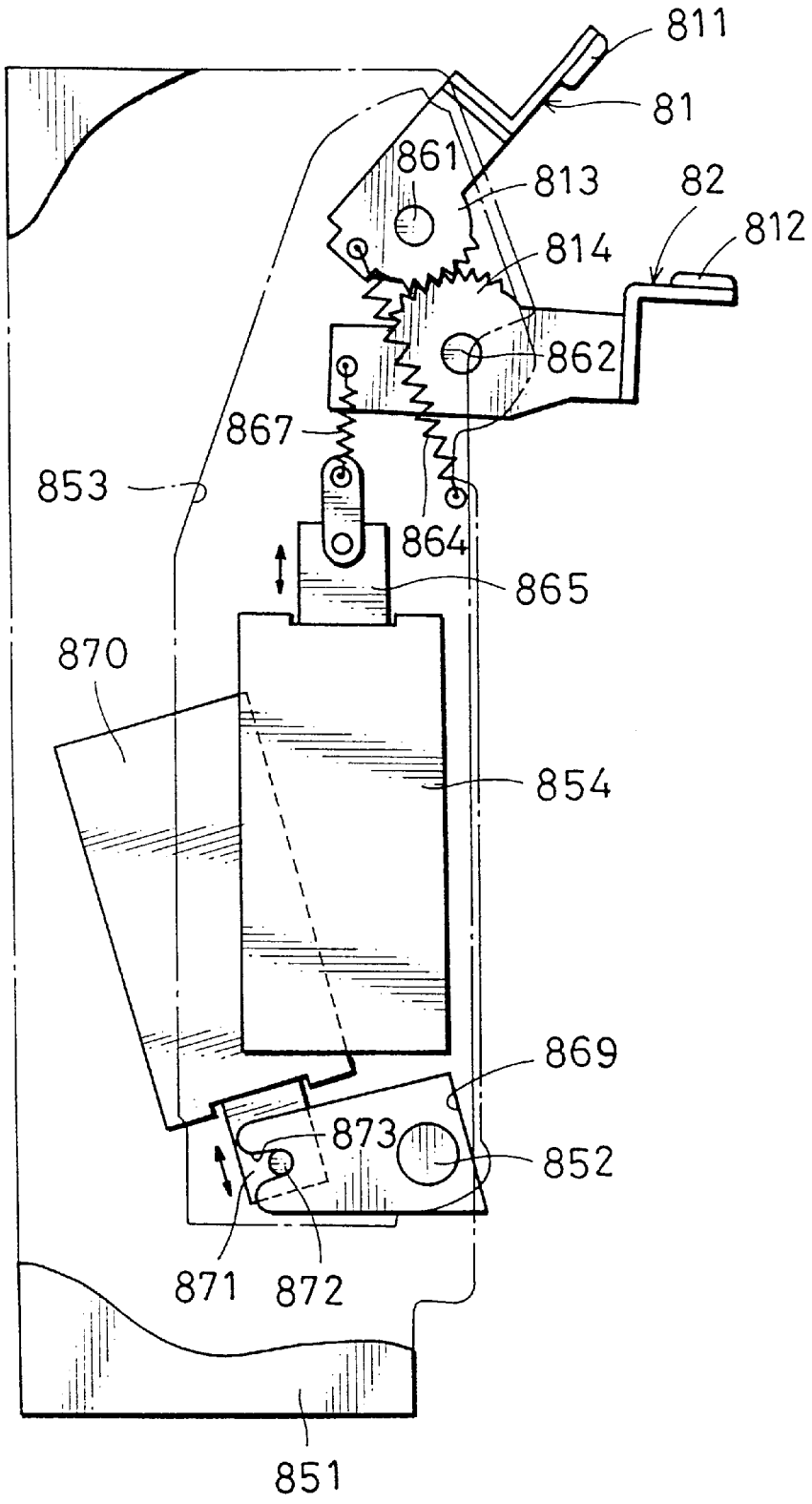
FIG. 7 is an explanatory diagram showing an internal arrangement of the hand unit.

As shown in FIG. 7, the hand unit 8 has a shaft 852 rotatably mounted on the opposing side walls of a frame member 851 thereof, and a hand support plate 853 fixedly mounted on the shaft 852. The hand unit 8 selectively changes its posture to the first state (retracted state, see FIG. 8) and to the second state (chuck state or projected state, see FIG. 7) where the hands 81 and 82 are operated to hold the sheet set on the intermediate tray 7. The operation as to how the hand unit 8 changes its posture is described later in detail.

The hand unit 8 includes a first solenoid 854 mounted at the lower portion of the hand support plate 853, and a pair of hands 81 and 82 arranged at the upper portion of the hand support plate 853 vertically opposing to each other.

The hands 81 and 82 respectively include a chucking portion 811 and 812 for holding a portion of the sheet set, and attachment portions 813 and 814. The attachment portion 813 (814) is mounted on the hand support plate 853 to be rotatable about a support pin 861 (862) that is fixed to the hand support plate 853 in the following manner.

Specifically, a tooth portion is formed along the outer perimeter of each attachment portion. In a meshed state of these tooth portions, the attachment portions 813 and 814 rotate in the opposite direction to pivotally move the hands 81 and 82 toward and away from each other so as to set the chucking portions 811 and 812 of the hand unit 8 to a closed state and to an opened state.

More specifically, a first coil spring 864 is connected between the attachment portion 813 of the hand 81 and the hand support plate 853. A second coil spring (possibly serving as a shock absorber) 867 is connected between the attachment portion 814 of the hand 82 and the lead end of a plunger 865 of the first solenoid 854. The hand unit 8 is changeably set to an opened state and to a closed state in the following manner.

When the first solenoid 854 is set to an OFF state (de-energized), the lead end of the plunger 865 protrudes a certain length out of a core of the solenoid 854, and the hands 81 and 82 are set to an opened state, i.e., away from each other in the opposite direction due to the bias force (restoring force) of the first coil spring 864, as shown in FIG. 7.

On the other hand, when set to an ON state (energized), the first solenoid 854 is set to another state (not shown) where the plunger 865 retracts inside the core of the solenoid 854 overcoming the bias force of the first coil spring 864. Thereby, the attachment portions 813 and 814 rotate in such a direction as to pivotally move the hands 81 and 82 toward each other in a meshed state of the tooth portions, thereby setting the hands 81 and 82 in a closed state. At the time of closing the hands 81 and 82, the motion of closing the hands 81 and 82 is moderate because a resilient force of the second coil spring 867 is applied against the retract movement of the plunger 865.

Next, the operation as to how the hand unit 8 is selectively set to the retract state and to the chuck enable state is described.

A pivot member 869 is rotatably mounted about the shaft 852 on the frame 851. The hand support plate 853 (i.e., the hands 81 and 82) is changeably set to the retract state shown in FIG. 8 and to the chuck enable state (projected state)

shown in FIG. 7 by a pivotal movement of the pivotable member 869 about the shaft 852 in the following manner by the operation of a second solenoid 870 that is fixedly mounted on the frame 851.

A pin 872 provided on the lead end of a plunger 871 of the second solenoid 870 is fitted in a recess 873 formed in the pivot member 869. Specifically, when the second solenoid 870 is in an OFF state (i.e., de-energized), the plunger 871 of the second solenoid 870 protrudes outside a core of the solenoid 870 by a certain length. That is, the hand support plate 853 rotates in the counterclockwise direction in FIGS. 7 and 8 about the shaft 852 and is set to the retract position shown in FIG. 8 where the hands 81 and 82 retract inside the frame 851 from the hollow space 713.

Figure 8:
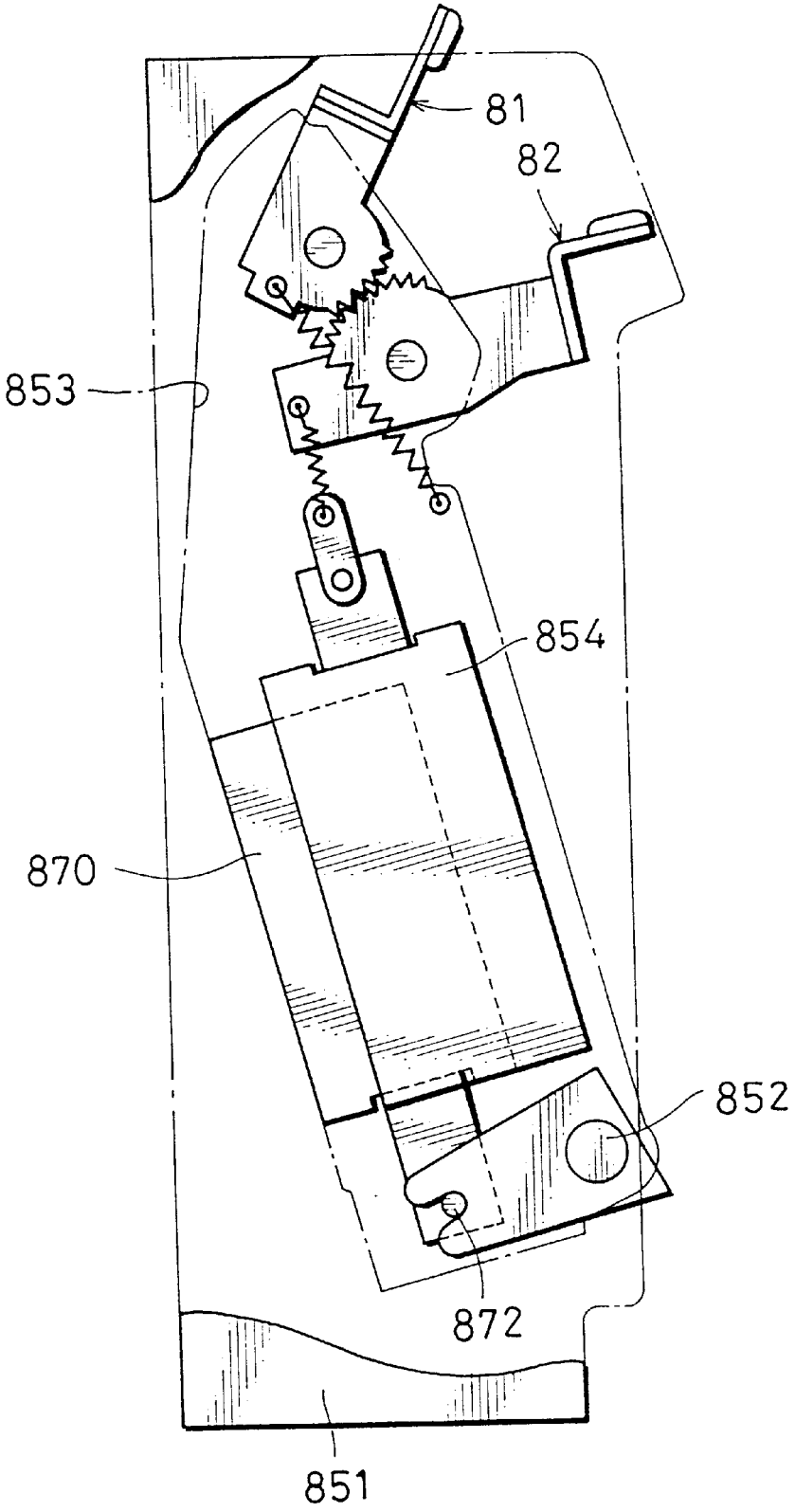
FIG. 8 is an explanatory diagram showing the internal arrangement of the hand unit.

On the other hand, when the second solenoid 870 is changed to an ON state (energized) where the plunger 871 retracts inside the core of the second solenoid 870, the hand support plate 853 rotates in the clockwise direction in FIGS. 7 and 8 about the shaft 852 to set the hand unit 8 to the chuck enable state shown in FIG. 7 where the hands 81 and 82 are exposed outside of the frame 851 (i.e., jutted in the space 713). When set to the chuck enable state, the hand unit 8 can be set to a closed state to hold a portion of the sheet set on the intermediate tray 7.

[Arrangement of control system]

Figure 9:
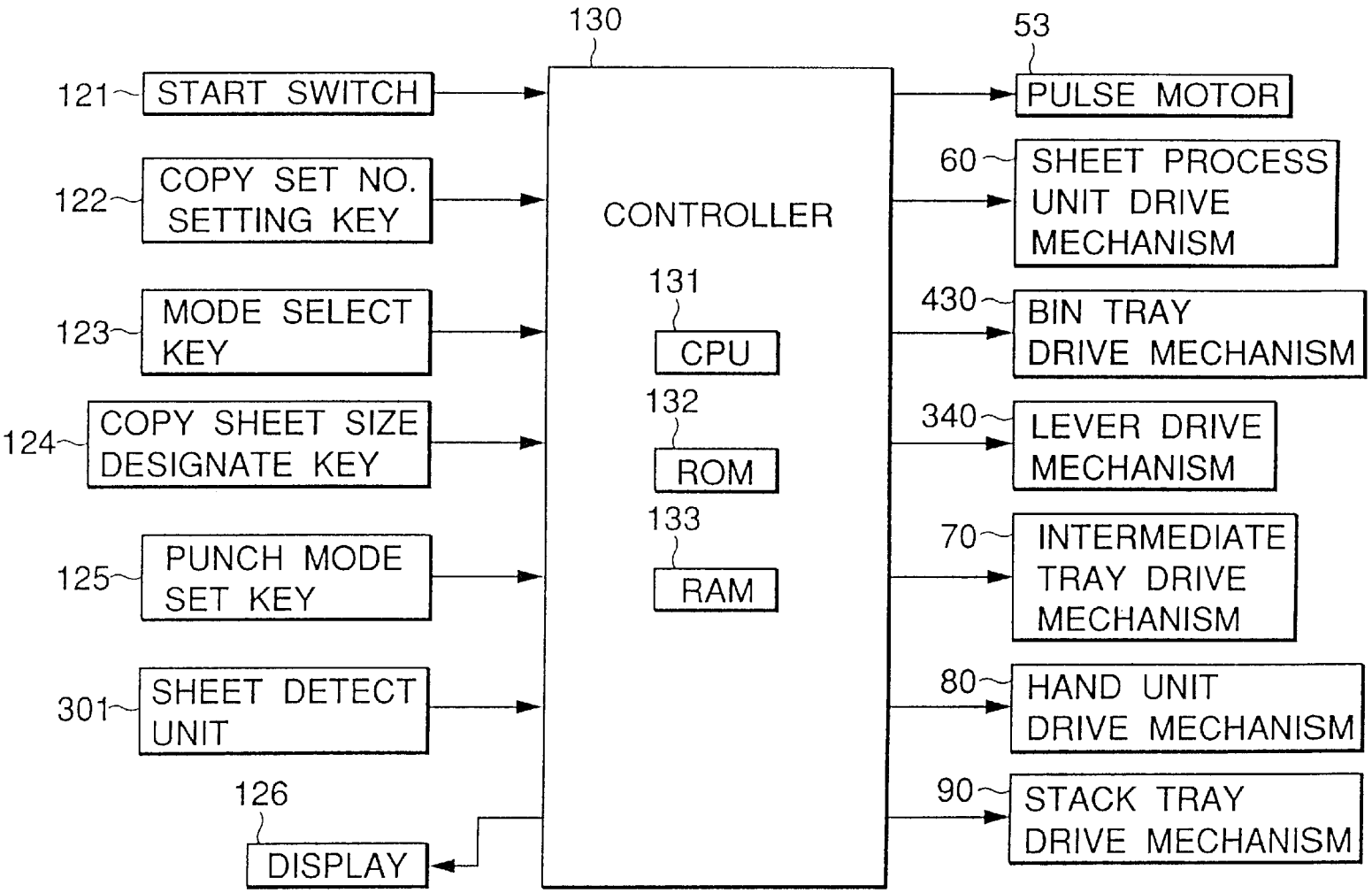
FIG. 9 is a block diagram showing a control system of the sheet handling unit.

Next, a control system of the sheet handling unit 3 is described with reference to FIG. 9.

The reference numeral 130 represents a controller. The controller 130 comprises a CPU 131 for performing a predetermined data processing, an ROM 132 in which a predetermined program is stored, and an RAM 133 for temporarily storing processed data, and controls an overall operation of the copying machine including the sheet handling unit 3 according to the predetermined program. The controller 130 is electrically connected to the following constituent elements via an input/output device (not shown).

More specifically, the CPU 131 controls driving of the pulse motor 53 for driving the spiral camshafts 51, a drive mechanism 60 for the sheet processing unit 6, a driving mechanism 430 for the bin trays 43, a driving mechanism 340 for the lever 34, the drive mechanism 70 for the intermediate tray 7, the drive mechanism 80 for the hand unit 8, and a drive mechanism 90 for the stack tray 9 upon receiving a signal outputted from the start switch 121, the copy sheet set number setting key 122, the mode selecting key 123, the copy sheet size designating key 124, the punching mode setting key 125, and the sheet detecting unit 301.

The sheet handling unit 3 is operated as follows.

When an operator sets a certain number of original documents on the document setting portion 111 of the automatic document feeder 11, sets the number of sheet sets to be obtained by the copy sheet set number setting key 122 and selects the sorter mode by the mode selecting key 123, designates the sheet size (e.g., A4 size) by the copy sheet size designating key 125 of the operation panel 12, and finally presses the start switch 121, an image forming operation starts.

When the sorter mode is designated, it means, in this embodiment, that a series of sheet handling processes (post process after the image formation) are conducted such that copy sheets are sorted out to obtain a certain number of sheet sets; a mechanical sheet processing (e.g., stapling) is applied to each sheet set; and these sheet sets with the mechanical sheet processing applied thereto are stacked one over another alternately at two different positions on the sheet stacker 9.

Upon start of the start switch 121, the original documents placed on the document setting portion 111 are successively fed onto a specified position of the contact glass for image reading, the images read by the optic system are copied one after another on copy sheets fed from the paper storage unit 2, and the copy sheets carrying the copied image are successively discharged out of the main body 1 of the copying machine toward the sheet handling unit 3.

Meanwhile, upon designation of certain conditions for the series of sheet handling processes (post process) to be conducted by the sheet handling unit 3 through various keys on the operation panel 12, the uppermost bin tray 43 of the bin unit 4 vertically shifts upward to the position opposing to the sheet outlet port 321 of the first transport path 32. Upon designation of the sheet size (in this case, A4 size), the intermediate tray 7 moves to the receiving position corresponding to A4 size opposing to the sheet outlet port 332 of the second transport path 33, and the sheet stacker 9 moves upward to the initial uppermost position within the movable range.

In this state, the first copy sheet after the image formation is guided to the sheet handling unit 3 through the inlet port 31 and discharged onto the uppermost bin tray 43 through the outlet port 321 while having been transported along the first transport path 32.

Specifically, the bin trays 43 are shifted upward stage by stage as timed with the sheet discharge operation of the first group of copy sheets each carrying the first copied image to sort out the first group of copy sheets on the bin trays 43.

Subsequently, when the next (second) group of copy sheets each carrying the second copied image are successively discharged out of the main body 1 of the copying machine, the bin trays 43 shift downward stage by stage to sort out the second group of copy sheets on the bin trays 43 such that the second copy sheet carrying the second copied image is placed over the first copy sheet carrying the first copied image. In this way, the bin trays 43 move up and down stage by stage each time a group of copy sheets carrying the copied images identical to each other are discharged on the bin trays 43 until the last group of copy sheets carrying the last copied image are discharged out of the main body 1. Thus, a certain number of sheet sets are obtained on the bin trays 43.

Upon completion of discharge of the last group of copy sheets on the bin trays 43, the bin trays 43 each carrying one sheet set thereon are lowered to the position opposing to the sheet processing unit 6 one by one. When the bin tray 43 carrying the sheet set to which a stapling is to be applied has been lowered to the position opposing to the sheet processing unit 6, the bin tray 43 moves toward the sheet processing unit 6, and the stopper 432 of the bin tray 43 rotates downward to jut out one end (+Y end) of the sheet set placed on the bin tray 43, thereby applying a stapling to the one end jutting out of the bin tray 43.

After the stapling, the bin tray 43 is returned to the initial position. Accompanied by returning of the bin tray 43 toward the initial position, the stopper 432 rotates upward, and the returning movement of the bin tray 43 continues until the pin 431 of the bin tray 43 is guided along the groove 52 of the spiral camshaft 51 to a specified position.

The above operation is cyclically repeated a certain number of times until all the sheet sets on the bin trays 43 have been applied with a stapling. Thereafter, the bin trays 43 each carrying the sheet set having been applied with the stapling thereon move down to the position opposing to the inlet port 331 of the second transport path 33 one after another. At this time, the lead end of the lever 34 in the inlet port 331 lifts up the sheet set while proceeding through the cutaway formed in the bin tray 43.

Simultaneously, the angular inclination of the bin tray 43 in the +Y direction greatly increases at the position opposing to the inlet port 331. Thereby, the sheet set on the bin tray 43 slides down over the downward slope, is guided to the second transport path 33 through the inlet port 331, and transported to the intermediate tray 7 through the outlet port 332 while being guided along the second transport path (transport guide member) 33.

At this time, the hand unit 8 is set to the home position opposing to the space 713 of the intermediate tray 7. Accordingly, the sheet set discharged through the outlet port 332 slides down along the slope of the intermediate tray 7 and lands at a certain position determined by the first stopper wall 711, corner ends of the frame 851 of the hand unit 8 and the second stopper wall 712, as shown in FIG. 5.

Specifically, the sheet set indicated at the symbol P (shown by the broken line in FIG. 5) lands on the intermediate tray 7 in a state that the lead end of the sheet set P in the −Y direction is abutted against the first stopper wall 711 and corner ends of the frame 851 of the hand unit 8, while the lateral end of the sheet set P in the −X direction is abutted against the second stopper wall 712. When the sheet set P lands on the intermediate tray 7 in this state, one portion of the sheet set P is exposed outside the intermediate tray 7, i.e., is set in a free state in the space 713.

Figure 10A:
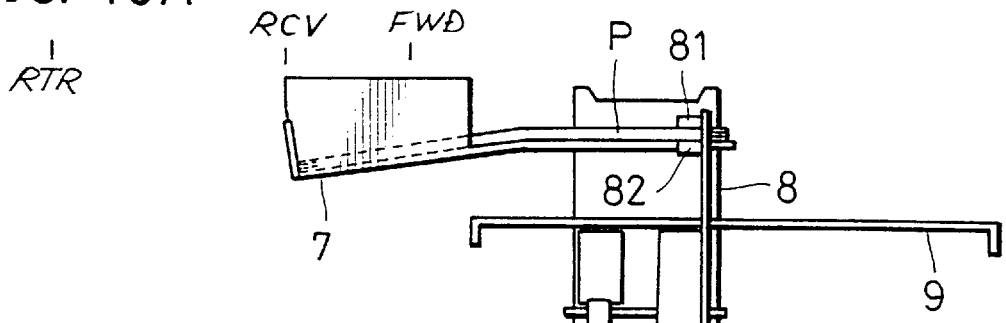
FIGS. 10A to 10E are schematic diagrams illustrating a series of steps as to how a sheet set is transferred from the intermediate tray onto a sheet stacker.

Next, a series of transferring operations of the sheet set P from the intermediate tray 7 onto the sheet stacker 9 are described with reference to FIGS. 10A to 10E. FIG. 10A shows a state that the sheet set P has just landed on the intermediate tray 7. In this state, the second solenoid 870 and the first solenoid 854 of the hand unit 8 are respectively activated to set the hands 81 and 82 to a chuck enable state where the hands 81 and 82 are exposed in the space 713 and to set the chucking portions 811 and 822 of the hands 81 and 82 to a closed state, thereby holding the sheet set P on the intermediate tray 7.

Figure 10B:
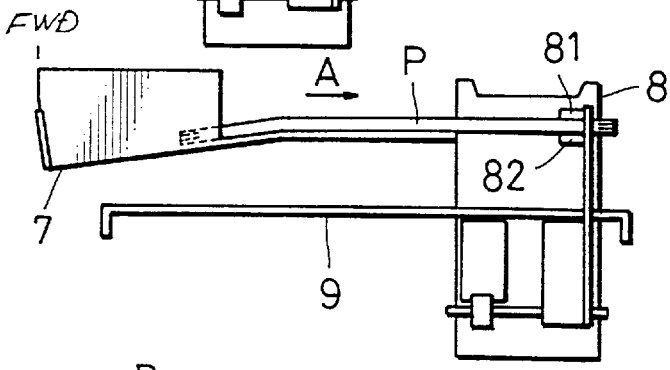

Subsequently, as shown in FIG. 10B, in a state that the hands 81 and 82 hold the sheet set P, the intermediate tray 7 and the hand unit 8 simultaneously move in the direction of arrow A (+X direction) toward the sheet releasing position above the sheet stacker 9 with the same speed. At this time, while the hand unit 8 moving to the sheet releasing position with the sheet set P held by the hands 81 and 82, the intermediate tray 7 travels up to the forward position short of the sheet releasing position in the +X direction. Accordingly, after the intermediate tray 7 halts its movement at the forward position, the hands 81 and 82 of the hand unit 8 keep carrying the sheet set P to the sheet releasing position.

Figure 10C:
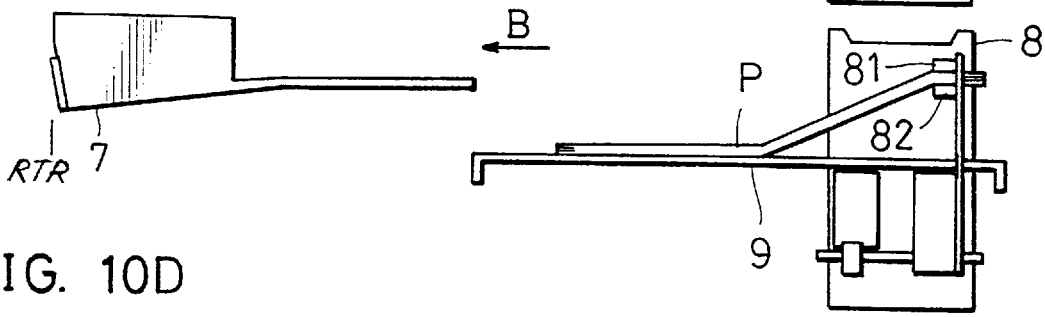

Upon reaching the sheet releasing position, as shown in FIG. 10C, the hand unit 8 suspends the movement in a state that the hands 81 and 82 still hold the sheet set P. At this time, the intermediate tray 7 is on the way from the forward position toward the retract position (in the −X direction shown by the arrow B). Consequently, the sheet set P is halfway transferred onto the sheet stacker 9 except the portion held by the hands 81 and 82 because the intermediate tray 7 is not present any more above the sheet stacker 9 (non-interference state of the intermediate tray).

Figure 10D:
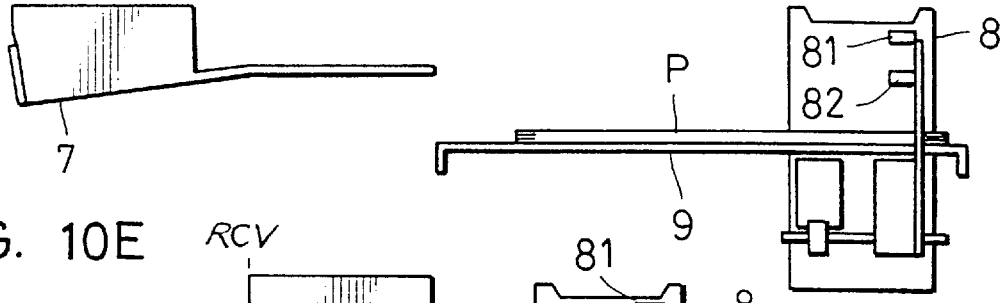

Subsequently, as shown in FIG. 10D, the first solenoid 854 is activated to set the hands 81 and 82 to an opened state to release the holding of the sheet set P, and almost at the same time (but immediately after), the second solenoid 870 is activated to set the hand unit 8 to the retract position away from the space 713 in the −Y direction. As a result, the entirety of the sheet set P is transferred onto the sheet stacker 9.

Figure 10E:
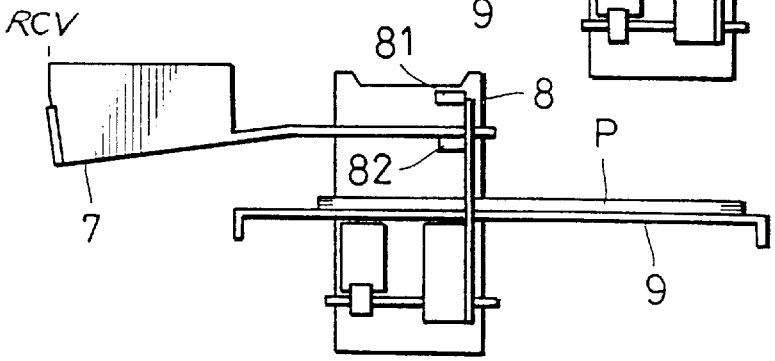

Thereafter, as shown in FIG. 10E, while the intermediate tray 7 moving from the retract position to the receiving position in the +X direction, the hand unit 8 returns from the sheet releasing position to the home position opposing to the space 713 of the intermediate tray 7 in a state that the hand unit 8 maintains its retract position with the hands 81 and 82 opened up.

Then, upon landing of the second sheet set onto the intermediate tray 7, the intermediate tray 7 at the receiving position and the hand unit 8 at the home position move toward the sheet releasing position simultaneously in a state that the hand unit 8 changes its position from the retract position to a chuck enable position and is set to a closed state to hold a portion of the second sheet set by the activation of the first and second solenoids 854 and 870, similar to the first transfer operation. At the time of transferring the second sheet set onto the sheet stacker 9, the hand unit 8 does not move to the first sheet releasing position P82*a*, but halts the movement at the second sheet releasing position P82*b*.

Figure 11:
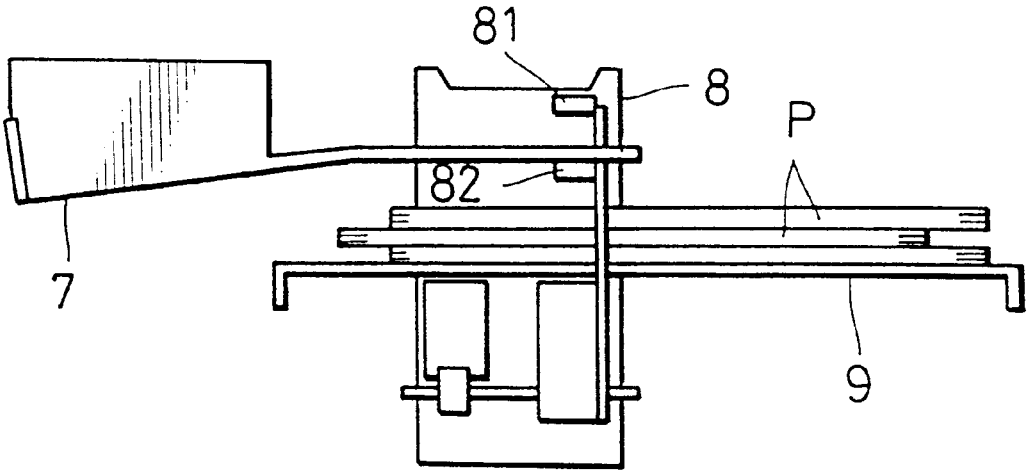
FIG. 11 is a schematic diagram showing a state that sheet sets have been stacked on the sheet stacker.

Specifically, each time a sheet set is discharged, the hand unit 8 alternately moves to the first sheet releasing position P82*a* and to the second sheet releasing position P82*b*. Accordingly, as shown in FIG. 11, the sheet sets are stacked on the sheet stacker 9 in a state that every other sheet set is stacked on the +X side and on the −X side. Upon stacking of all the sheet sets placed on the bin trays 43 on the sheet stacker 97 the operator carries away the piled up sheet sets on the sheet stacker 9 from the +X side (front side in FIG. 2).

As mentioned above, upon detection by the sheet detecting unit 301 that the uppermost sheet set of the piled up sheet sets has reached the predetermined height level, the sheet stacker 9 lowers by one pitch. In this way, each time the sheet detecting unit 301 detects that the uppermost sheet set has reached the predetermined height, the sheet stacker lowers by one pitch. Thereby, the sheet stacker 9 maintains the height thereof substantially at a certain level to securely receive all the sheet sets from the intermediate tray 7 at the predetermined position.

According to the sheet handling unit 3 having the above arrangement, after having been temporarily received on the intermediate tray 7 through the outlet port 332, the sheet sets are successively transferred onto the sheet stacker 9 from above. Accordingly, there can be eliminated the drawbacks of the prior art in which the sheet sets are stacked in a non-aligned state because the next coming sheet set may likely displace the previously stacked sheet set forward due to a frictional force generated between these sheet sets.

Further, even in the case where a stapling has been applied to the sheet sets, there can be eliminated the possibility that the surface of the sheet set is damaged by the staple(s) applied to the next coming sheet set or to the previously stacked sheet set.

Furthermore, according to the sheet handling unit 3 having the above arrangement, the sheet stacker 9 is arranged on the front side of the copying machine, i.e., on the +X side. Accordingly, an operator can take out the piled up sheet sets on the sheet stacker 9 from the front side with ease, which facilitates the taking out operation by the operator.

As shown in FIG. 10B, in this embodiment, the intermediate tray 7 stops at the forward position before the sheet releasing position after the intermediate tray 7 and the hand unit 8 simultaneously start moving in the +X direction toward the sheet releasing position.

Alternatively, the intermediate tray 7 may move to the sheet releasing position as the hand unit 8 does. However, in the operation of the above embodiment, the intermediate tray 7 can be ready for moving to the retract position before the hand unit 8 reaches the sheet releasing position, which can save the operation time for driving the intermediate tray 7. This realizes saving time required for transferring the sheet set from the intermediate tray 7 onto the sheet stacker 9.

Further, in the foregoing embodiment, as shown in FIG. 10A, the intermediate tray 7 set at the receiving position partially overlies the sheet stacker 9 in the Z direction. There may be taken an altered form in which the sheet stacker 9 is arranged further away in the +X direction than the position shown in FIG. 3 or FIG. 10A to eliminate the overlying state of the intermediate tray 7 at the receiving position above the sheet stacker 9. In this case, however, the receiving position of the intermediate tray 7 becomes closer to the retract position, or in an extreme case, coincides with the retract position.

In the above embodiment in which the intermediate tray 7 at the receiving position partially overlies the sheet stacker 9 as shown in FIG. 10A, the moving distance of the intermediate tray 7 can be shortened to save the operation time for driving the intermediate tray 7, while saving the time required for transferring the sheet set from the intermediate tray 7 onto the sheet stacker 9.

Moreover, according to the above embodiment, the intermediate tray 7 and the hand unit 8 simultaneously move toward the sheet releasing position above the sheet stacker 9 upon landing of the sheet set on the intermediate tray 7. This arrangement may take the following alteration in which the intermediate tray 7 does not have to move toward the sheet releasing position.

Specifically, in this alteration, at the initial state, the sheet stacker 9 may be set further on the +X side such that the intermediate tray 7 is disposed above the sheet stacker 9 away therefrom in the −X direction (e.g., the position shown in FIG. 10C). From this initial state, the hand unit 8 may be moved toward the sheet releasing position with the hands 81 and 82 thereof holding a portion of the sheet set, while setting the intermediate tray 7 in a stationary state. In this alteration, also, the sheet set can be carried away from the intermediate tray 7 onto the sheet stacker 9.

With this alteration, the similar effect as in the embodiment can be obtained even if a stapling is to be applied to the sheet set by allowing the hands 81 and 82 to hold a portion of the sheet set near the staple(s) applied thereto. Thus, there can also be eliminated the drawbacks of non-aligned stacked state of sheet sets on the sheet stacker 9 and damage of the sheet surface in contact to each other due to the staple(s).

As another modification, in the initial state, the sheet stacker 9 may be arranged further on the −X side than the position shown in FIG. 3, i.e., the intermediate tray 7 may substantially overlie the sheet stacker 9 (e.g., the position shown in FIG. 10B). From this state, the intermediate tray 7 may move to the retract position in a state that the hands 81 and 82 hold the sheet set. Thereby, similar to the embodiment, the sheet set can be transferred from the intermediate tray 7 onto the sheet stacker 9.

In this modification, the intermediate tray 7 does not have to move toward the sheet releasing position, and the hand unit 8 can hold and release the sheet set at the home position (i.e., without moving to the sheet releasing position). Accordingly, the time required for transferring the sheet set from the intermediate tray 7 onto the sheet stacker 9 can be reduced.

In the foregoing embodiment, the sheet sets are piled up on the sheet stacker 9 in a state that every other sheet set is stacked on the opposite sides. Alternatively, the sheet sets may be piled up on the sheet stacker without shifting the stacking position alternately.

Further, the sheet handling unit in the embodiment is incorporated with the sheet processing unit 6. However, the sheet handling unit may not comprise the sheet processing unit. In this case, also, the intermediate tray can be constructed in the similar manner as in the foregoing embodiment, and the sheet sets can be stacked on the sheet stacker 9 alternately on the opposite sides (with a simplified construction).

To sum it all up, the sheet handling unit of this invention comprises: a sheet stacker on which sheet sets are stacked one over another; a transport guide member including an inlet port and an outlet port for receiving the sheet sets through the inlet port and discharging the sheet sets through the outlet port successively; and an intermediate tray disposed at a position higher than the sheet stacker for receiving the sheet set discharged through the outlet port at a predetermined receiving position to transfer the sheet set onto the sheet stacker.

Preferably, the sheet handling unit may further comprise a hand unit disposed adjacent to the intermediate tray for holding a portion of the sheet set discharged onto the intermediate tray to transfer the sheet set onto the sheet stacker.

With this arrangement, the sheet set discharged onto the intermediate tray is securely transferred onto the sheet stacker with the aid of the hand unit, thereby eliminating a possibility of non-aligned stacked state. Further, even if a stapling has been applied to the sheet set, there can be eliminated a possibility that the surface of the sheet sets in contact to each other is damaged by the staple(s).

Preferably, the sheet handling unit may further comprise: an intermediate tray driver which moves the intermediate tray to a retract position away from the sheet stacker; and a hand unit driver which drives the hand unit to hold the portion of the sheet set on the intermediate tray while the intermediate tray is moved to the retract position for preventing carrying away of the sheet set along with the intermediate tray and to release the holding of the sheet set upon arrival of the intermediate tray at the retract position.

With this arrangement, the intermediate tray moves to the retract position away from the sheet stacker. During the movement of the intermediate tray to the retract position, the hand unit keeps holding the portion of the sheet set lying on the intermediate tray. Accordingly, the sheet set stays at the position together with the hand unit while the intermediate tray being moved away toward the retract position. In this state, the sheet set is halfway transferred onto the sheet stacker with the one portion thereof held by the hand unit. Upon arrival of the intermediate tray at the retract position, the hand unit releases the holding of the sheet set. Thereby, the entirety of the sheet set completely lands on the sheet stacker to finalize the transfer operation onto the sheet stacker.

More preferably, the intermediate tray driver may move the intermediate tray from the receiving position to a forward position above the sheet stacker prior to the movement thereof to the retract position, and the hand unit driver moves the hand unit to a sheet releasing position for enabling transfer of the sheet set from the intermediate tray onto the sheet stacker while keeping the hand unit to hold the portion of the sheet set during the movement of the intermediate tray to the forward position.

With this arrangement, prior to arrival at the retract position, the intermediate tray moves to the forward position above the sheet stacker. At this time, the hand unit also moves to the sheet releasing position as the intermediate tray is moved to the forward position, while keeping holding the portion of the sheet set to transfer the sheet set onto the sheet stacker at the sheet releasing position. Upon arrival at the sheet releasing position, the movement of the hand unit is suspended, and the hand unit releases the holding of the sheet set. Meanwhile, the intermediate tray moves to the retract position. Thus, the sheet set is transferred onto the sheet stacker without interfering the intermediate tray.

It may be preferable that the sheet releasing position includes two points different from each other and the hand unit driver moves the hand unit to the two points alternately each time the sheet set is transferred from the intermediate tray onto the sheet stacker.

Thereby, each time the sheet set is to be transferred onto the sheet stacker, the hand unit alternately moves to the two different sheet releasing positions. Accordingly, the sheet sets are stacked on the sheet stacker in a state that they are alternately piled up at two different stacking positions.

Preferably, the receiving position may be set variable according to the size of the sheet set. Thereby, the intermediate tray receives the sheet set at the specified receiving position corresponding to the size of sheet set.

Preferably, the intermediate tray may be arranged away from the sheet stacker, and the hand unit driver may move the hand unit to a sheet releasing position for enabling transfer of the sheet set from the intermediate tray onto the sheet stacker while keeping the hand unit to hold the portion of the sheet set and cause the hand unit to release the holding of the sheet set upon arrival of the hand unit at the sheet releasing position.

With this arrangement, the hand unit moves to the sheet releasing position above the sheet stacker while holding the portion of the sheet set. Then, the hand unit releases the holding of the sheet set upon reaching the sheet releasing position. Thereby, the sheet set can securely land on the sheet stacker in a state that the hand unit pauses at the sheet releasing position without interfering the intermediate tray.

Preferably, the intermediate tray may include a plane having a downward slope in a sheet set discharge direction for receiving the sheet set discharged through the outlet port of the transport guide member and a first stopper wall at a lead end thereof with respect to the sheet set discharge direction.

With this arrangement, the sheet set discharged from the outlet port of the transport guide member slides over the downward slope and stops at the first stopper wall. Accordingly, the sheet set can securely land on the intermediate tray at the predetermined position in a state that the lead end of the sheet set is aligned along the first stopper wall.

Preferably, the intermediate tray may include a plane having a downward slope on a side thereof away from the sheet stacker in a direction orthogonal to the sheet set discharge direction and a second stopper wall at an end thereof away from the sheet stacker with respect to the direction orthogonal to the sheet set discharge direction.

With this arrangement, even if the sheet set lands at a position off the predetermined receiving position, the sheet set slides over the downward slope and stops at the second stopper wall. Accordingly, the sheet set can securely land on the intermediate tray at the predetermined position in a state that the end of the sheet set away from the sheet stacker is aligned along the second stopper wall.

More preferably, the sheet handling unit may further comprise a bin unit disposed opposing to the inlet port of the transport guide member for sorting out copy sheets thereon to obtain sheet sets so as to guide the sheet sets successively to the inlet port of the transport guide member.

Thereby, the copy sheets are sorted on the bin unit to obtain sheet sets, and the sheet sets are successively guided to the inlet port of the transport guide member.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A sheet handling unit for handling sheet sets comprising:

a sheet stacker on which the sheet sets are stacked one over another;

a transport guide unit including an inlet port and an outlet port for receiving the sheet sets through the inlet port and for discharging the sheet sets through the outlet port successively;

an intermediate tray device disposed at a receiving position higher than the sheet stacker for receiving the sheet sets discharged from the outlet port to transfer the sheet sets onto the sheet stacker; and a hand unit disposed adjacent to said intermediate tray device for gripping a portion of each sheet set discharged onto said intermediate tray device to transfer the sheet set onto said sheet stacker.

2. The sheet handling unit according to claim 1 wherein the intermediate tray device includes an intermediate tray unit and an intermediate tray driver:

said intermediate tray driver being operable to move the intermediate tray unit to a retract position away from the sheet stacker;

said hand unit including a hand unit holder and a hand unit driver, said hand unit driver being operable to drive said hand unit holder to grip the portion of the sheet set on the intermediate tray unit while the intermediate tray unit is moved to the retract position for preventing carrying away of the sheet set along with the intermediate tray unit and to release the gripping of the sheet set upon arrival of the intermediate tray unit at the retract position.

3. The sheet handling unit according to claim 2, wherein the intermediate tray driver moves the intermediate tray unit from the receiving position to a forward position above the sheet stacker prior to the movement of the intermediate tray unit to the retract position, and the hand unit driver moves the hand unit holder to a sheet releasing position for enabling transfer of the sheet set from the intermediate tray unit onto the sheet stacker while the hand unit holder grips the portion of the sheet set during the movement of the intermediate tray unit to the forward position.

4. The sheet handling unit according to claim 3, wherein the sheet releasing position includes two sub-positions different from each other, and the hand unit driver moves the hand unit holder to the two sub-positions alternately each time the sheet set is transferred from the intermediate tray unit onto the sheet stacker.

5. The sheet handling unit according to claim 1, wherein the receiving position is set variable according to the size of the sheet set.

6. The sheet handling unit according to claim 1, wherein the intermediate tray device is arranged away from the sheet stacker, said hand unit including a hand unit driver and a hand unit holder, said hand unit driver moving the hand unit holder to a sheet releasing position for enabling transfer of the sheet set from the intermediate tray device onto the sheet stacker while the hand unit holder grins the portion of the sheet set, said hand unit driver driving the hand unit holder to release the gripping of the sheet set upon arrival of the hand unit holder at the sheet releasing position.

7. The sheet handling unit according to claim 1, wherein the sheet set discharges from said outlet port of said transport guide unit in a downwardly sloped sheet set discharge direction, the intermediate tray device including a downwardly sloped surface sloped downwardly in the same direction as the direction of the downward slope of said downwardly sloped sheet set discharged direction for receiving the sheet set discharged through the outlet port of the transport guide unit, said intermediate tray device having a downstream end with respect to said sheet set discharge direction, said intermediate tray device having a first stopper wall at said downstream end.

8. The sheet handling unit according to claim 1, wherein the sheet set discharges from said outlet port of said transport guide unit in a downwardly sloped sheet set discharge direction, the intermediate tray device including a downwardly sloped surface sloped downwardly in a direction generally perpendicular to the direction of the downwardly sloped sheet set direction, said intermediate tray device having one side generally parallel to said sheet set discharge direction and a stopper wall at said one side of said intermediate tray device.

9. The sheet handling unit according to claim 1, further comprising a bin unit disposed opposite the inlet port of the transport guide unit for sorting out copy sheets on the bin unit to obtain sheet sets and to guide the sheet sets successively to the inlet port of the transport guide unit.

10. The sheet handling unit according to claim 1, wherein said hand unit includes at least a first hand and a second hand for gripping the portion of the sheet set.

11. The sheet handling unit according to claim 10, wherein said pair first and second hands engage a top surface and a bottom surface of the portion of the sheet set.

12. The sheet handling unit according to claim 1, wherein said hand unit includes a frame member, a hand support plate pivotably mounted on said frame member, and at least a first hand and a second hand pivotably mounted on said hand support plate.

13. The sheet handling unit according to claim 12, wherein said hand unit further comprises an actuator mounted on said hand support plate for changing a state of said hands between a gripping state wherein said hands grip the portion of the sheet set and an opened state wherein said hands are released from gripping the portion of the sheet set.

14. The sheet handling unit according to claim 13, further comprising a second actuator mounted on said frame member for moving said hand support plate between a retracted position wherein said hands are disposed away from the sheet set and a grip enable position wherein said hands are disposed proximate the sheet set for gripping the sheet set on said intermediate device.

15. A sheet handling unit for handling sheet sets comprising:

a sheet stacker on which sheet sets are stacked one over another;

a transport guide unit including an inlet port and an outlet port for receiving the sheet sets through the inlet port and discharging the sheet sets through the outlet port successively;

an intermediate tray disposed at a predetermined receiving position higher than the sheet stacker for receiving the sheet set discharged through the outlet port to transfer the sheet set onto the sheet stacker;

a hand unit disposed adjacent to the intermediate tray for holding a portion of the sheet set discharged onto the intermediate tray to transfer the sheet set onto the sheet stacker;

an intermediate tray driver which moves the intermediate tray to a retract position away from the sheet stacker;

a hand unit driver which drives the hand unit to hold the portion of the sheet set on the intermediate tray while the intermediate tray is moved to the retract position for preventing carrying away of the sheet set along with the intermediate tray and to release the holding of the sheet set upon arrival of the intermediate tray at the retract position;

said intermediate tray driver moving the intermediate tray from the receiving position to a forward position above the sheet stacker prior to the movement of the intermediate tray to the retract position, and the hand unit moving the hand unit to a sheet releasing position for enabling transfer of the sheet set from the intermediate tray onto the sheet stacker while the hand unit continues to hold the portion of the sheet set during the movement of the intermediate tray to the forward position.

16. The sheet handling unit according to claim 15, wherein the sheet releasing position includes two sub-positions different from each other, and the hand unit driver moves the hand unit to the two sub-positions alternately each time the sheet set is transferred from the intermediate tray onto the sheet stacker.

17. A sheet handling unit for handling sheets after an image formation comprising:

a bin unit for sorting out copy sheets to form copy sheet sets;

a transport guide unit including an inlet port and an outlet port for receiving the sheet sets through the inlet port and discharging the sheet sets through the outlet port successively;

said bin unit being disposed juxtaposed to the inlet port of the transport guide unit so as to guide the sheet sets successively to the inlet port of the transport guide units;

a sheet stacker on which sheet sets are stacked one over another; and an intermediate tray disposed at a receiving position higher than the sheet stacker for receiving the sheet sets discharged from the outlet port of said transport guide unit and for transferring the sheet sets onto the sheet stacker.

18. The sheet handling unit according to claim 17 wherein said transport guide unit discharges the sheet sets from the outlet port in a downwardly sloped sheet set direction;

said intermediate tray including a sloped lateral surface sloped downwardly in a lateral direction extending generally laterally to the direction of the downwardly sloped sheet set direction, said sloped lateral surface having a lateral side which extends downwardly in a lateral direction parallel to said sloped lateral surface, and a lateral stopper wall extending upright from said lateral sloped side of said sloped lateral surface.

19. A sheet handling unit for handling sheet sets comprising:

a sheet stacker on which the sheet sets are stacked one over another;

a transport guide unit including an inlet port and an outlet port for receiving the sheets sets through the inlet port and for discharging the sheet sets from the outlet port in a downwardly sloped sheet set direction;

an intermediate tray disposed at a receiving position higher than the sheet stacker for receiving the sheet set discharged through the outlet port to transfer the sheet set onto the sheet stacker;

said intermediate tray including an intermediate tray unit and an intermediate tray driver, said intermediate tray driver driving said intermediate tray unit in a lateral direction extending generally laterally to the direction of the downwardly sloped sheet set direction.

* * * * *